US006019089A

United States Patent [19]

Taylor et al.

[11] Patent Number: 6,019,089

[45] Date of Patent: Feb. 1, 2000

[54] ARRANGEMENT FOR ORIENTING A FUEL INJECTOR TO A FUEL MANIFOLD CUP

[75] Inventors: Timothy Gerald Taylor, Livonia; Matthew Moyler Cole, Plymouth; James Braden Roberts; William Beal Fort, both of Dearborn, all of Mich.

[73] Assignee: Ford Motor Company, Dearborn, Mich.

[21] Appl. No.: 09/172,048

[22] Filed: Oct. 14, 1998

[51] Int. Cl.[7] ..... F02M 55/02

[52] U.S. Cl. ..... 123/470; 123/456

[58] Field of Search ..... 123/470, 472, 123/469, 468, 458, 509

[56] References Cited

U.S. PATENT DOCUMENTS 4,294,215 10/1981 Hans et al. .
4,307,693 12/1981 Glockler et al. .
4,475,516 10/1984 Atkins et al. .
4,823,754 4/1989 Minamoto et al. .
4,984,548 1/1991 Hudson, Jr. .
4,991,557 2/1991 DeGrace et al. .
4,993,390 2/1991 Ono et al. .
5,035,224 7/1991 Hornby et al. .
5,038,738 8/1991 Hafner et al. .
5,040,512 8/1991 Twilton .
5,074,269 12/1991 Herbon et al. .
5,136,999 8/1992 Bassler et al. .
5,301,647 4/1994 Lorraine .
5,680,545 10/1997 Peng .
5,724,946 3/1998 Franchitto .

*Primary Examiner*—Carl S. Miller
*Attorney, Agent, or Firm*—Jerome R. Drouillard

[57] ABSTRACT

An orientation clip (42) has an axially- and circumferentially-united attachment with a fuel injector (13) to orient the fuel injector circumferentially within a cup (32) on a fuel manifold (30). The clip has axially extending orientation tabs (46) that pass through open spaces provided by notches (56) in the rim of the cup to circumferentially locate the clip to the cup, and hence the fuel injector to the cup.

8 Claims, 2 Drawing Sheets

ARRANGEMENT FOR ORIENTING A FUEL INJECTOR TO A FUEL MANIFOLD CUP

BACKGROUND OF THE INVENTION

1. Field of the Invention

This invention relates generally to an arrangement for orienting an electric-operated fuel injector to an injector-receiving cup of a fuel manifold. The disclosed embodiment of the invention illustrates an arrangement for orienting a top-feed fuel injector to a cup of a fuel manifold using an orientation clip that is attached to the fuel injector and that includes a feature relating with a complementary feature of the cup to circumferentially locate the fuel injector about a center line of the cup and fuel injector while allowing the fuel injector, once circumferentially oriented, to position itself axially within the cup when being assembled to the fuel manifold.

2. Background Information

Spark-ignited, fuel-injected internal combustion engines enjoy extensive usage as the powerplants of automotive vehicles. Fuel is injected into an intake system of such an engine by electric-operated fuel injectors of a fuel manifold assembled to the engine. Such a manifold is also known as a fuel rail.

Various arrangements for the assembly and mechanical retention of an electric-operated fuel injector to and on a cup of a fuel manifold are shown in a number of patents, including U.S. Pat. Nos. 4,294,215; 4,307,693; 4,475,516; 4,823,754; 4,984,548; 4,993,390; 5,040,512; 5,074,269; 5,136,999; 5,680,845; and 5,724,946.

Certain fuel injectors inject fuel in a direction, or directions, that are other than along the fuel injector centerline. Such fuel injectors are sometimes called targeted fuel injectors. A split stream fuel injector is one example. When a targeted fuel injector is associated with an engine into which it injects fuel, the fuel injector should have a particular circumferential orientation about its centerline so that the direction(s) of fuel injection will be properly targeted. Improperly targeted fuel injectors may derogate engine performance and/or compliance with applicable vehicle standards.

Proper targeting of a fuel injector may also require proper axial positioning of the fuel injector. This can be accomplished by locating the fuel injector nozzle, which contains one or more metering orifices from which fuel is injected into an engine, in fixed geometric relation to a socket receptacle of the engine intake system into which the nozzle is inserted in a sealed manner. When a fuel manifold containing fuel injectors that have been properly circumferentially located in respective cups of the fuel manifold is assembled to an engine that has injector-receiving socket receptacles, the act of inserting the nozzles into properly sealed relationship with the socket receptacles can complete proper targeting of the fuel injectors.

A fuel manifold may comprise attachment features, apertured brackets for example, with which threaded fasteners are associated to fasten the fuel manifold to an engine. Once the fuel injector nozzles have seated in properly targeted positions in the socket receptacles, a need for further tightening of such fasteners in order to secure the fuel manifold on the engine may induce undesired stress, distortion and/or movement. For example, if fuel injector nozzles have been seated in properly targeted positions in respective socket receptacles in engine intake manifold runners before the manifold attachment fasteners have been fully torqued, the fuel manifold may distort in some way, and/or there may be some relative movement between some component parts, as the fasteners are finally tightened to full installation torque. With prevailing manufacturing procedures and dimensional tolerances of manufactured parts, it seems that the possibility of such distortion, or movement of component parts, at time of fuel manifold assembly to an engine, cannot be totally foreclosed in all circumstances.

It is known from one or more of the above patents to mechanically retain a fuel injector in a cup by a retention clip that constrains the two against any substantial movement, both circumferentially and axially. In certain circumstances, the presence of strict axial constraint may be undesirable from the standpoint of assembling a fuel manifold to an engine. For example, it is believed that strict axial constraint may contribute to undesired stress, distortion, and/or component part movement occurring during manifold assembly to an engine. Therefore, it is seen desirable to provide for fuel injector orientation relative to a cup which retains proper orientation for injector targeting purposes, but without such strict axial orientation that could result in, or aggravate, certain undesired effects when a manifold is assembled to an engine. A fuel manifold that incorporates such a capability may improve serviceability should it become necessary to remove the fuel manifold from an engine and thereafter re-install it.

SUMMARY OF THE INVENTION

The present invention relates generally to a fuel manifold assembly comprising a fuel manifold tube for conveying pressurized fuel, an electric-operated fuel injector comprising a body having a fuel inlet at which fuel is introduced into the fuel injector body and a nozzle from which fuel is injected out of the fuel injector body, a cup which is disposed outwardly open on the fuel manifold tube and receives the fuel inlet in a sealed manner to provide for fuel to pass from the manifold tube into the fuel inlet, and an orientation clip orienting the fuel injector to the cup. The orientation clip and fuel injector body have an axially- and circumferentially-united attachment with each other. The cup comprises a peripheral circumferential rim, including a locating feature, and the orientation clip comprises a located feature. One of the locating and the located features comprises an axially extending orientation tab that subtends an arc about a centerline of the fuel injector and cup and that has a free distal end. The other of the locating and the located features comprises circumferentially spaced apart surfaces that circumferentially bound an open space through which the orientation tab axially passes, thereby circumferentially capturing the orientation tab. The locating and the located features are constructed to allow the orientation tab to enter and move axially through the open space as a portion of the fuel injector body containing the inlet is being axially inserted into the outwardly open cup during assembly of the fuel injector into the manifold assembly.

Other general and more specific aspects will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
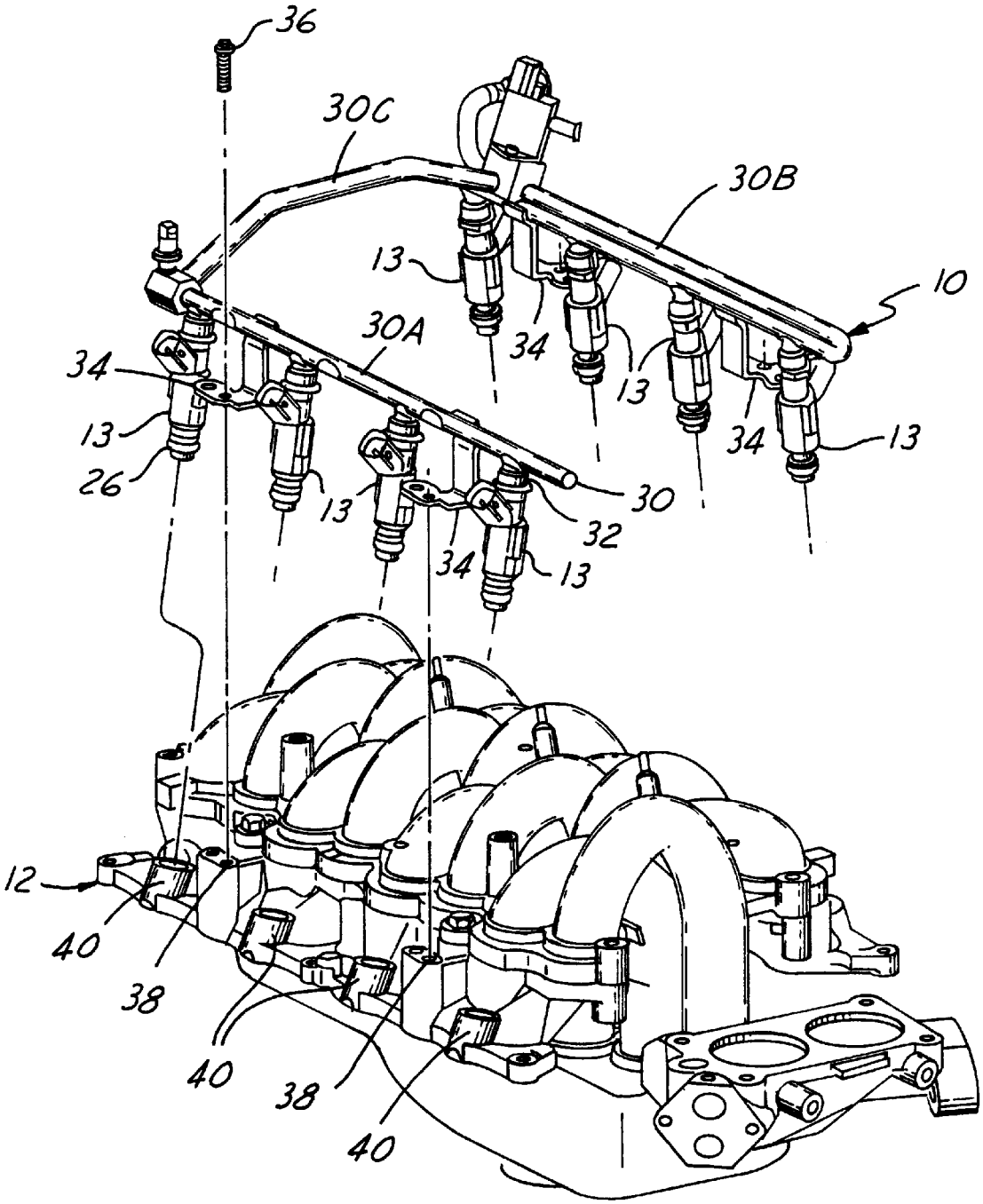
FIG. 1 is a perspective view of a fuel manifold, including fuel injectors, and a related portion of an internal combustion engine, with the fuel manifold and fasteners exploded away.

FIG. 1 shows a representative fuel manifold 10 embodying principles of the present invention, and adapted for attachment to an intake manifold 12 of a spark-ignited, internal combustion engine. The illustrated manifolds 10, 12 are configured for an eight-cylinder V-type engine, with fuel manifold 12 comprising eight electric-operated fuel injectors 13 of the top-feed type.

Figure 2:
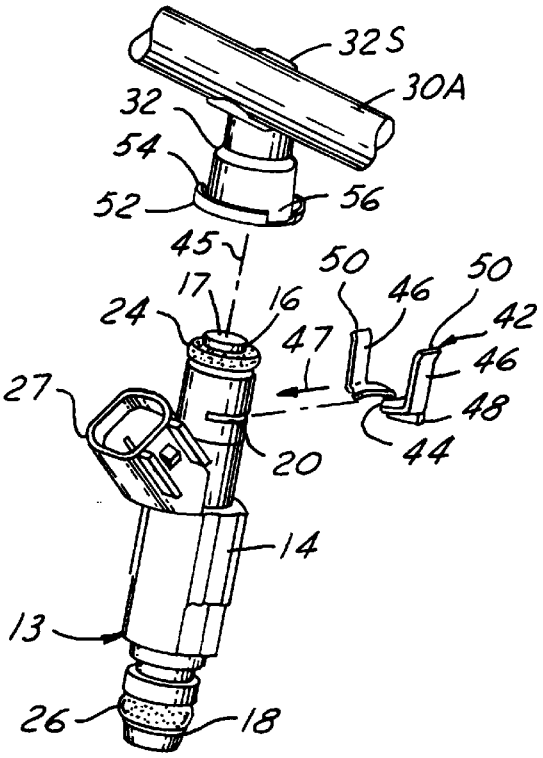
FIG. 2 is a fragmentary perspective view of a portion of the fuel manifold, one of the fuel injectors, and a corresponding orientation clip, with the fuel injector and the orientation clip exploded away.
Figure 3:
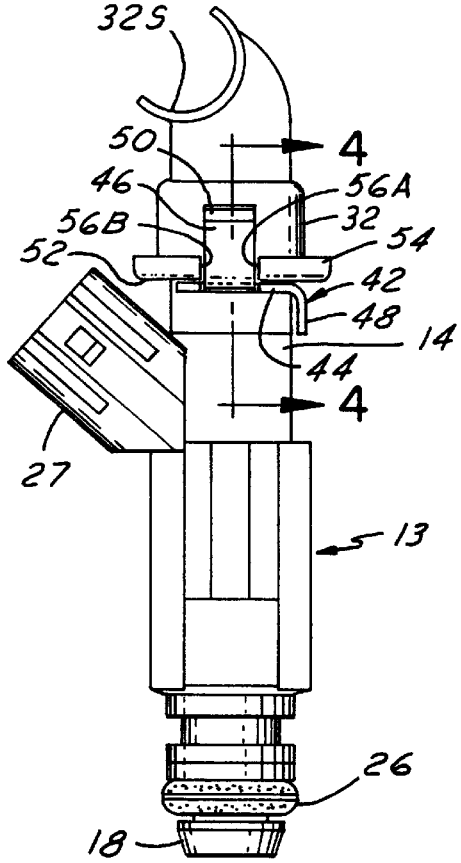
FIG. 3 is a longitudinal side view of the fuel injector, orientation clip, and the fuel manifold in assembly relationship.
Figure 4:
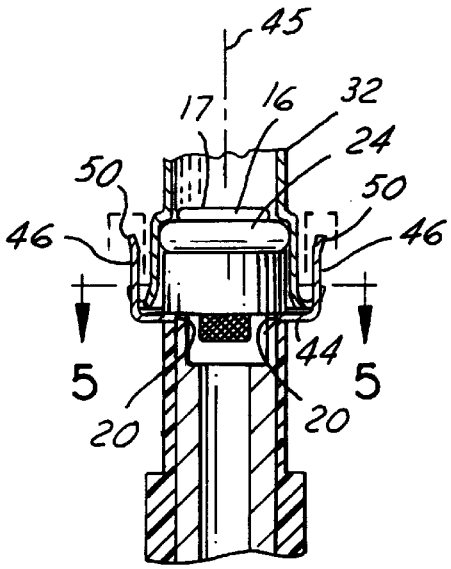
FIG. 4 is a fragmentary transverse cross section view in the direction of arrows 4—4 in FIG. 3.

As can be more fully seen in FIGS. 2–4, each fuel injector 13 comprises a body 14, including a fuel inlet tube 16 at one axial end. The free end of fuel inlet tube 16 provides a fuel inlet opening 17 via which pressurized liquid fuel can enter the fuel injector. The opposite axial end of fuel injector 13 comprises a nozzle 18 containing one or more metering orifices from which fuel is injected out of fuel injector body 14.

The exterior of a portion of body 14 surrounding fuel inlet tube 16 comprises radially outwardly open grooves 20 diametrically opposite each other. An O-ring seal 24 is disposed about tube 16 just axially below fuel inlet opening 17. Another O-ring seal 26 is disposed externally about nozzle 18. Fuel injector 13 further comprises an electric connector 27 containing electric terminals adapted for mating connection with respective terminals of a connector of a wiring harness leading to an electric control circuit (not shown) for electrically-operating the fuel injector to produce fuel injections in properly timed relation to engine operating cycles.

FIG. 1 shows fuel manifold 10 to comprise several metal parts assembled together to form a fuel tube 30 through which pressurized liquid fuel from a suitable source (not shown) is conveyed to fuel injectors 13. Fuel tube 30 has two parallel metal branch tubes 30A, 30B connected by a cross-over branch tube 30C. Each branch tube 30A, 30B contains four formed-metal cups 32. Each cup 32 has a saddle 32S for fitting the cup to the respective branch tube 30A, 30B, and opens outwardly opposite the saddle for receiving the fuel inlet end of a respective fuel injector 13 in a sealed manner to provide for fuel from the branch tube to enter the fuel inlet tube 16 through the fuel inlet opening 17.

Several metal attachment brackets 34 containing apertures are affixed externally to fuel manifold tube 30, and the threaded shanks of headed screws 36 are passed through brackets 34 and tightened into threaded holes 38 in intake manifold 12 to fasten fuel manifold 10 to the engine. When the fuel manifold is so attached, nozzles 18 are received in respective receptacle sockets 40 of intake manifold 12 to provide for fuel to be injected into respective runners leading to respective engine cylinders, with O-rings 26 providing fluid-tight radial sealing of the nozzles to wall surfaces of the receptacle sockets.

A stamped metal orientation clip 42 orients each fuel injector 13 to a respective cup 32. Clip 42 comprises an injector-gripping clip body 44 that is disposed essentially perpendicular to a center line 45 of fuel injector 13. Clip body 44 is apertured to allow it to be snapped onto the fuel injector from the side, as suggested by arrow 47 in FIG. 2. The aperture in clip body 44 provides marginal edge portions that lodge in grooves 20 to thereby axially and circumferentially unite orientation clip 42 and fuel injector 13 in attachment.

Orientation clip 42 further includes axially extending orientation tabs 46 projecting axially from outer margins of diametrically opposite sides of clip body 44. At 90° to orientation tabs 46, a shorter tab 48 projects from the outer margin of body 44 in the opposite axial direction from orientation tabs 46. Each orientation tab 46 subtends an arc about center line 45 and terminates in a free distal end 50 that is canted radially outward.

Each cup 32 comprises a peripheral circumferential rim 52 that includes a reverse-turned lip 54 forming a channel that is open axially in a direction opposite the cup opening. Two notches 56 are disposed diametrically opposite each other in lip 54. Each notch 56 is defined by circumferentially spaced apart surfaces 56A, 56B of cup 32 that circumferentially bound an open space. Each notch 56 subtends an arc about center line 45 that is slightly greater than that subtended by each orientation tab 46.

Figure 5:
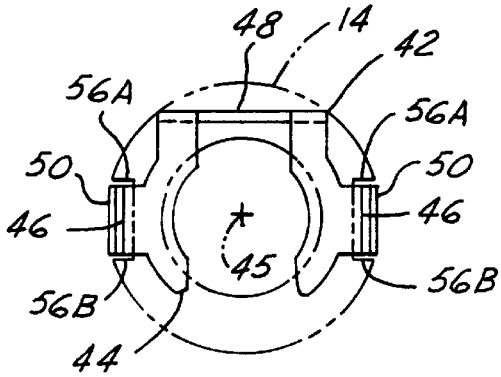
FIG. 5 is an end view of the orientation clip, as taken in the direction of arrows 5—5 in FIG. 4 and enlarged.

FIGS. 3–5 show a fuel injector 13 assembled to a cup 32. Orientation tabs 46 pass axially through the open spaces provides by notches 56, with surfaces 56A, 56B circumferentially constraining tabs 46 so that orientation clip 42 is circumferentially located relative to cup 32 about center line 45, which is now common to both fuel injector and cup. Because orientation clip 42 is circumferentially united with fuel injector 13, nozzle 18 is properly circumferentially located about center line 45 to cup 32 so that proper fuel targeting within the corresponding intake manifold runner is achieved after fuel manifold 10 has been installed on intake manifold 12. Circumferential targeting within 5° may be considered acceptable.

By providing sufficient axial length for the cup wall with which O-ring 24 seals, it becomes possible for O-ring 24 to assume sealing with cup 32 over a range of axial positions during assembly of fuel injector 13 to the cup. Such assembly comprises first attaching clip 42 to fuel injector 13 as explained above, and then, as suggested by FIGS. 2 and 4, axially aligning the fuel injector inlet end to the outwardly open cup, with tabs 46 disposed in circumferential registration with notches 56. Then the injector and the cup are increasingly advanced axially toward each other.

A representative final installation position is shown by FIGS. 3–5. While those Figures show essentially maximum axial insertion of the fuel injector inlet end into cup 32, lesser extents of acceptable insertion are possible. Because of the inventive arrangement, including the provision of suitable dimensional clearance between cup rim 52 and nearby portions of clip 42, and of clearance between the inner wall surface of cup 32 and nearby portions of fuel injector 13, excluding O-ring 24, the inlet end of the fuel injector, including O-ring 24, can be better self-centering within the cup. It is believed that the inventive arrangement renders the O-ring seal more, and possibly even fully, immune to potential adverse effects of side-loading that may occur for any reason, but can occur during the process of fastening the fuel manifold to the engine.

While a presently preferred embodiment has been illustrated and described, it is to be appreciated that the invention may be practiced in various forms within the scope of the following claims.

What is claimed is:

1. A fuel manifold assembly comprising a fuel manifold tube for conveying pressurized fuel, an electric-operated fuel injector comprising a body having a fuel inlet end at which fuel is introduced into the fuel injector body and a nozzle from which fuel is injected out of the fuel injector body, a cup which is disposed on the fuel manifold tube and opens outward to receive the fuel inlet end in a sealed manner to provide for fuel to pass from the manifold tube into the fuel injector body, and an orientation clip orienting the fuel injector to the cup, the orientation clip and fuel injector body having an axially- and circumferentially-united attachment with each other, the cup comprising a peripheral circumferential rim, including a locating feature, at an open outer end of the cup, and the orientation clip comprising a located feature, the located feature comprising an axially extending orientation tab that subtends an acute angle about a centerline of the fuel injector and cup and that has a free distal end, the locating feature comprising circumferentially spaced apart surfaces in the cup rim that subtend an acute angle about a centerline of the fuel injector and cup and circumferentially bound an open space through which the orientation tab axially passes, thereby circumferentially capturing the orientation tab, and the locating and the located features are constructed to allow the orientation tab to enter and move axially through the open space as the fuel inlet end of the fuel injector body is being axially inserted into the outwardly open cup during assembly of the fuel injector into the manifold assembly.

2. A fuel manifold assembly comprising a fuel manifold tube for conveying pressurized fuel, an electric-operated fuel injector comprising a body having a fuel inlet end at which fuel is introduced into the fuel injector body and a nozzle from which fuel is injected out of the fuel injector body, a cup which is disposed on the fuel manifold tube and opens outward to receive the fuel inlet end in a sealed manner to provide for fuel to pass from the manifold tube into the fuel injector body, and an orientation clip orienting the fuel injector to the cup, the orientation clip and fuel injector body having an axially- and circumferentially-united attachment with each other, the cup comprising a peripheral circumferential rim, including a locating feature, and the orientation clip comprising a located feature, one of the locating and the located features comprising an axially extending orientation tab that subtends an arc about a centerline of the fuel injector and cup and that has a free distal end, the other of the locating and the located features comprising circumferentially spaced apart surfaces that circumferentially bound an open space through which the orientation tab axially passes, thereby circumferentially capturing the orientation tab, and the locating and the located features are constructed to allow the orientation tab to enter and move axially through the open space as the fuel inlet end of the fuel injector body is being axially inserted into the outwardly open cup during assembly of the fuel injector into the manifold assembly, in which the locating feature comprises a radially outwardly open notch in a peripheral circumferential rim of the cup, and the orientation tab is disposed on the orientation clip, and in which the locating feature comprises another radially outwardly open notch in the peripheral circumferential rim of the cup diametrically opposite the first-mentioned notch, and the orientation clip comprises another axially extending orientation tab that subtends an arc about a centerline of the fuel injector and cup diametrically opposite the first-mentioned orientation tab and that has a free distal end, the another notch comprising circumferentially spaced apart surfaces that circumferentially bound another open space through which the another orientation tab axially passes, thereby circumferentially capturing the another orientation tab, and the another orientation tab and the another notch are constructed to allow the another orientation tab to enter and move axially through the another open space as the fuel inlet end of the fuel injector body is being axially inserted into the outwardly open cup during assembly of the fuel injector into the manifold assembly.

3. A fuel manifold assembly as set forth in claim 2 in which the fuel inlet end of the fuel injector comprises a tube that has a fuel inlet opening at one axial end, and an O-ring seal is disposed externally about the tube and provides a circumferentially continuous radial seal between the tube and an interior wall surface of the cup.

4. A fuel manifold assembly as set forth in claim 3 in which the free distal end of each orientation tab is canted radially outward.

5. A fuel manifold assembly comprising a fuel manifold tube for conveying pressurized fuel, an electric-operated fuel injector comprising a body having a fuel inlet end at which fuel is introduced into the fuel injector body and a nozzle from which fuel is injected out of the fuel injector body, a cup which is disposed on the fuel manifold tube and opens outward to receive the fuel inlet end in a sealed manner to provide for fuel to pass from the manifold tube into the fuel injector body, and an orientation clips orienting the fuel injector to the cup, the orientation clip and fuel injector body having an axially- and circumferentially-united attachment with each other, the cup comprising a peripheral circumferential rim, including a locating feature, and the orientation clip comprising a located feature, one of the locating and the located features comprising an axially extending orientation tab that subtends an arc about a centerline of the fuel injector and cup and that has a free distal end, the other of the locating and the located features comprising circumferentially spaced apart surfaces that circumferentially bound an open space through which the orientation tab axially passes, thereby circumferentially capturing the orientation tab, and the locating and the located features are constructed to allow the orientation tab to enter and move axially through the open space as the fuel inlet end of the fuel injector body is being axially inserted into the outwardly open cup during assembly of the fuel injector into the manifold assembly, in which the locating feature comprises a radially outwardly open notch in the peripheral circumferential rim of the cup, and the orientation tab is disposed on the orientation clip, and in which the peripheral circumferential rim of the cup comprises a reverse-turned lip forming a channel that is open axially in a direction opposite that in which the cup is outwardly open, and the circumferentially spaced apart surfaces that circumferentially bound the open space are disposed in the reverse-turned lip.

6. A fuel manifold assembly as set forth in claim 1 in which the axially- and circumferentially-united attachment of the orientation clip and fuel injector body with each other comprises radially outwardly open grooves diametrically opposite each other in the fuel injector body and radially inwardly directed edge margins diametrically opposite each other in the orientation clip gripping the injector body, including fitting respectively in the respective grooves.

7. A fuel manifold assembly comprising a fuel manifold tube for conveying pressurized fuel, an electric-operated fuel injector comprising a body having a fuel inlet end at which fuel is introduced into the fuel injector body and a nozzle from which fuel is injected out of the fuel injector body, a cup which is disposed on the fuel manifold tube and opens outward to receive the fuel inlet end in a sealed manner to provide for fuel to pass from the manifold tube into the fuel injector body, and an orientation clip orienting the fuel injector to the cup, the orientation clip and fuel injector body having an axially- and circumferentially-united attachment with each other, the cup comprising a peripheral circumferential rim, including a reverse-turned lip containing at least one notch, the orientation clip comprising an axially extending orientation tab that subtends an arc about a centerline of the fuel injector and cup and that has a free distal end, the notch comprising circumferentially spaced apart surfaces that circumferentially bound an open space through which the orientation tab axially passes, thereby circumferentially capturing the orientation tab, and the orientation tab and the notch are constructed to allow the orientation tab to enter and move axially through the open space as the fuel inlet end of the fuel injector body is being axially inserted into the outwardly open cup during assembly of the fuel injector into the manifold assembly.

8. A method of assembling an electric-operated fuel injector to a fuel manifold, the fuel injector comprising a body having a fuel inlet end at which fuel is introduced into the fuel injector body and a nozzle from which fuel is injected out of the fuel injector body, the fuel manifold comprising a fuel manifold tube for conveying pressurized fuel, a cup which is disposed on the fuel manifold tube opens outward to receive the inlet end of the fuel injector body in a sealed manner to provide for fuel to pass from the manifold tube into the fuel injector body, the cup comprising a peripheral circumferential rim, including a locating feature, at an open outer end of the cup, the method comprising attaching to the fuel injector body an orientation clip having a located feature, adapted to be located by the locating feature of the cup, to axially- and circumferentially-unite the fuel injector body and the orientation clip, orienting the fuel injector to the cup, including causing the locating feature of the cup to locate the located feature of the clip, and moving the fuel injector body and the cup axially toward each other to pass an axially extending orientation tab, which is disposed on the clip and which subtends an acute angle about a centerline of the fuel injector and cup, through an open space bounded circumferentially by spaced apart surfaces in the rim of the cup that subtend an acute angle about a centerline of the cup to thereby circumferentially capture the orientation tab, and then increasingly moving the injector body and the cup axially toward each other.

* * * * *